US005131659A

United States Patent [19]

Lindberg, Jr.

[11] Patent Number: 5,131,659

[45] Date of Patent: Jul. 21, 1992

[54] GOLF PUTTING TRAINING AND PRACTICE AID

[76] Inventor: Eugene J. Lindberg, Jr., 3613 Westchester Ct., Middletown, Md. 21769

[21] Appl. No.: 728,149

[22] Filed: Jul. 10, 1991

[51] Int. Cl.[5] ..... A63B 69/36

[52] U.S. Cl. ..... 273/183 E; 273/192; 359/838

[58] Field of Search ..... 350/600, 641, 590; 273/35 A, 183 E, 192, 191 R, 183 A, 32 H, 187 A

[56] References Cited

U.S. PATENT DOCUMENTS

| | | | |
|---|---|---|---|
| 3,332,688 | 7/1967 | Gevertz | 273/192 X |
| 3,934,874 | 1/1976 | Henderson | 273/192 X |
| 4,483,536 | 11/1984 | Mitchell | 273/183 E |
| 4,666,264 | 5/1987 | Yamabe | 350/641 |
| 4,906,084 | 3/1990 | Christianson | 350/590 |

FOREIGN PATENT DOCUMENTS

| | | | |
|---|---|---|---|
| 2130103 | 5/1984 | United Kingdom | 273/35 A |

*Primary Examiner*—George J. Marlo
*Attorney, Agent, or Firm*—Sherman and Shalloway

[57] ABSTRACT

A golf putting training and practice aid for use by right or left handed golfers to improve their putting stance and stroke comprising a reflective sheet adapted for placement on the ground and provided with indicia to indicate eye position, shoulder position, and putter position and travel relative to the reflection of a golfer standing over the device. The indicia comprise a target line along the longitudinal center of the sheet, a center line perpendicular to and bisecting the target line, a pre-impact correction and length gauge along the target line to one side of the center line, a pair of putter head guide lines parallel to and on either side of the target line and shoulder guide lines between the putter head guide lines and the parallel edges of the sheet. Preferably, the device is made from a relatively thin sheet of transparent acrylic which measures 18×12 inches and has a coating of reflective aluminum vacuum deposited on one side and the indicia printed on the other side thereby forming a mirror in which the golfer views his reflection relative to the indicia.

9 Claims, 1 Drawing Sheet

FIG. 1
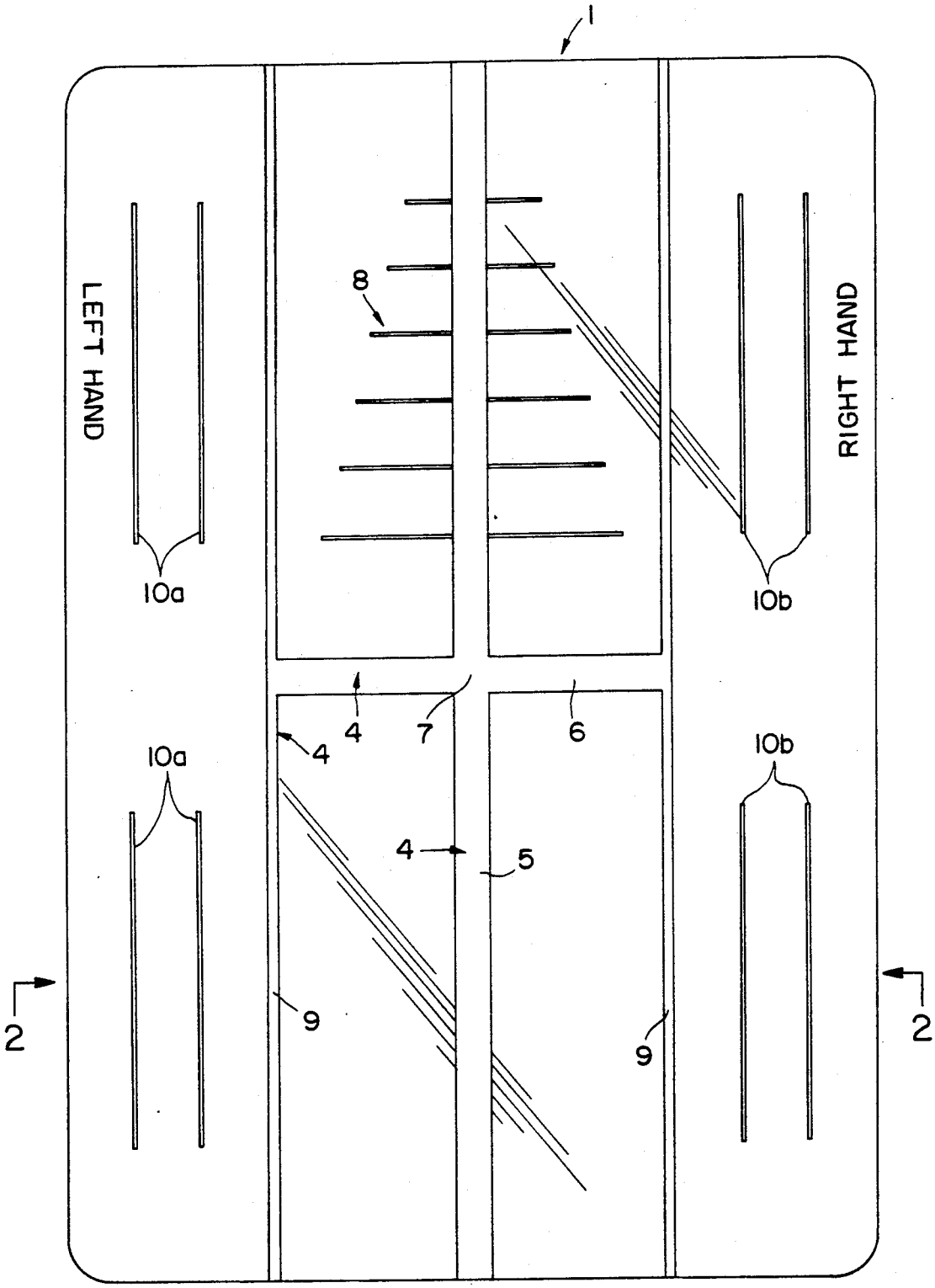
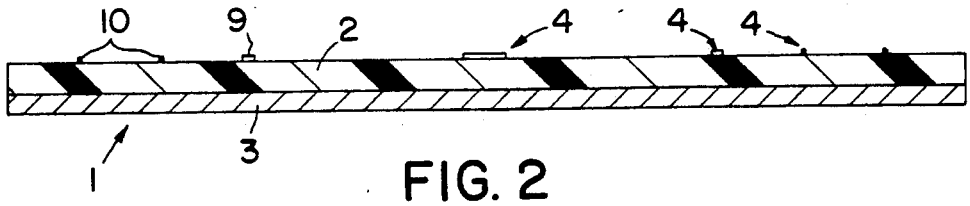
FIG. 2

GOLF PUTTING TRAINING AND PRACTICE AID

BACKGROUND OF THE INVENTION

This invention relates to a golf putting training and practice aid that is portable, easy to use anywhere and provides the golfer with immediate feedback regarding his putting stroke.

Proper stance, eye location and club stroke are crucial to accurate putting in the game of golf. One missed stroke on the green can mean the difference between winning and losing. Accordingly, it is important for a golfer to be able to practice his putting in such a manner as to be able to be apprised of what he is doing wrong and how to correct it.

Previous means and methods of obtaining such feedback have involved individual instruction from a golf pro who watches the golfer, analyzes the mistakes made and suggests ways to correct them. This can be expensive and requires the golfer to actually go to the course on a regular schedule for his instruction. Video tape is also used to record the golfer's movements so that it can be played back, often with review and comments by the golf pro or instructor. Again, this requires expensive equipment and the presence of another person.

What is needed is a device that allows the golfer to see his stance in relationship to the ball and to watch his putting stroke as it progresses thereby providing instant feedback to the golfer.

Such devices are known; however, they are deficient in that they do not provide a means whereby the golfer can view his stance, stroke and ball position in combination as his putting stroke is made.

For example, Henderson, in U.S. Pat. No. 3,934,874, describes a putting aid comprising a channel shaped member having a width between side walls that is sufficient for the passage of a putter head. A reflective insert at the bottom of the channel allows the golfer to concentrate his eye position on the ball but provides no indication of his relative stance which can affect the actual stroke of the club. This device is also intended to be used with a golf ball in place.

Whittaker, in U.S. Pat. No. 3,934,882, describes a golf guide designed to aid the golfer in aligning the club head at a precise right angle with respect to the desired path of the ball immediately before hitting it and to guide the club in the proper arc away from the ball after hitting it. Toward this end, the device comprises a flat elongated member that is pointed at one end to indicate the direction for the ball to follow and which has a notch or other means at the opposite end to locate the device relative to the ball at rest. A centerline is visually indicated by a longitudinal stripe thereby providing a guide for the club head to follow after striking the ball. Although the surface of the device is reflective, there is no way for the golfer to gauge his relative stance beyond his eye position over the ball.

Shirhall, in U.S. Pat. No. 4,000,905, describes a practice mat made from a carpet material and having indicia to indicate the stance and ball position for different clubs and golfers of different heights and reach. Stance is indicated by a series of lines showing the golfer where to place his feet with a second and third series of lines to indicate the angle and reach of the particular club being used. No provision is made for the golfer to actually see his overall body position over the mat.

SUMMARY OF THE INVENTION

The present invention provides a device whereby a golfer may practice and perfect his putting stroke with or without a ball and at any location with or without an instructor present. The device comprises a relatively thin sheet of mirrorized transparent acrylic or similar polymer on which are printed a series of indicia to provide guidance for stance, eye position and club stroke which can be viewed by the golfer as he is using the device. This ability to view all aspects of the putting stroke at the same time enables the golfer to spot problems affecting his stroke and to correct them.

In use, the golfer places the device on the ground or floor and stands over it in such a manner that his eye is over the ball location indicated by a pair of major intersecting lines. His shoulders will line up with a par of lines printed toward one edge of the sheet and he will be able to view his reflection and see this alignment. Further indicia along the center line of the sheet provide a guide for the club to follow during the putting stroke and are such as to readily indicate to the golfer when the putter head is at an undesirable angle to the proper path. An improper angle for the putter will result in a "push" or a "pull" of the ball Which will cause it to travel to one side or the other of the desired path.

It is therefor an object of the invention to provide a golf putting training and practice aid which may be used on or off the golf course.

It is a further object to provide a golf putting training and practice aid which permits the user to correct his stance and stroke as he is putting.

It is a still further object to provide a golf putting training and practice aid wherein the user may view his reflection relative to position and guidance indicia thereon.

And it is a still further object to provide a golf putting training and practice aid which may be used with or without a golf ball to correct and perfect a golfer's stance and putting stroke.

Other objects and intentions will be evident from the following drawings and detailed description of the invention.

DESCRIPTION OF THE DRAWINGS

FIG. 1 is a top planar view of the device of the invention.

FIG. 2 is a cross section taken along line 2—2 of FIG. 1 showing the preferred construction of the device.

DETAILED DESCRIPTION OF THE INVENTION

As shown in the drawing figures, the putting training device 1 of the present invention is preferably a substantially rectangular sheet of mirrorized acrylic which is made from a sheet of transparent acrylic 2 on one side of which has been vacuum deposited a layer of aluminum 3 forming a reflective coating. The sheet is preferably about 12 inches wide, about 18 inches long and about 0.06 inch thick. In order to prevent chipping and possible breakage, the four corners are given a radius as shown in FIG. 1.

This combination of acrylic and vacuum deposited aluminum provides a substantially breakage resistant mirror that is at least 96% distortion free. Other materials may be used to construct the mirror such as reflectorized mylar sheets together with other mono- or copolymers as long as they have a mirrored surface whereby a user may see his reflection. Although the preferred material, acrylic, is substantially rigid, it is within the concept of this invention that a material of greater flexibility which would permit the device to be rolled up when not in use or being transported may be used so long as it adheres to the requirement of having a reflective surface in which a golfer may view his reflection relative to indicia provided on the sheet.

The surface of the acrylic sheet 2 opposite the aluminum layer 3 is provided with printed indicia 4 against which the golfer compares his stance and stroke. The indicia are preferably applied by the silk screen method of printing although other methods of application may be used. Alternatively, the indicia may be printed on the same side of the sheet 2 as the aluminum layer 3 before that layer is applied so that they will be viewed through the transparent acrylic. In this manner the indicia will be protected from wear and disfigurement.

The indicia is made up of a series of lines of differing width and length by which the user can position himself and guide the putter for an accurate stroke.

The first of these lines is the target line 5 which extends along the longitudinal center of sheet 2 to indicate the intended and desired line of travel of the putter head, the roll of the golf ball and the vertical position of the golfer's eyes. Center line 6 is perpendicular to and bisects target line 5 forming a cross that indicates the ball position. Center line 6 preferably does not extend across the full width of sheet 2 but only a distance on either side of target line 5 that is preferably equivalent to one half the length of a putter head. The total length of center line 6 should be essentially equivalent to the full length of a regulation size putter head. Center line 6 also provides a position reference for the horizontal positioning of a golfer's eyes and is used to detect swaying or any lateral movement of the head and body. Peeking, or looking up at the target prematurely, before ball impact has been completed and follow through has begun is also indicated by reference to this line.

Ball position 7 at the intersection of target line 5 and center line 6 is the location of the golf ball placement and the position at which the golfer's leading eye should be visible when the ball is addressed. For right handed golfers the leading eye is their left eye and for left handed golfers it is their right eye. When the golfer is properly positioned over the device and looking downward at it he should see his reflection and his leading eye should appear to be directly over ball position 7.

To one side of center line 6, intersecting and perpendicular to target line 5, are a series of lines of decreasing length forming a pre-impact correction and length gauge 8. The lines of this gauge 8 are preferably narrower than target line 5 and are equidistantly spaced from center line 6 to one end edge of sheet 2 with the shortest line nearest the edge and the longest line nearest center line 6. Gauge 8 provides a means of squaring the putter face before impact as it is drawn through the stroke. The golfer's peripheral vision detects an open or closed putter face allowing correction to be made before impact. In addition, gauge 8 provides a means for measuring the length of the backstroke based on the length of the putt to be made. Because the device is reversible for left or right handed golfers only one gauge 8 is necessary. Reversing the sheet from the position for a right handed golfer to that for a left hander, or vice versa, will position gauge 8 on the correct side for the particular golfer's backstroke.

Target line 5, center line 6 and gauge 8 are preferably confined within a pair of putter head guide lines 9 which extend the length of sheet 2 and are parallel to and on opposite sides of target line 5. The distance between each of the putter head guide lines 9 is equal to the length of center line 6 and is preferably equivalent to the length of a regulation putter head. In this manner, putter head guide lines 9 represent a visual channel along which the putter should travel during a putting stroke and any deviation of the putter inside or outside of these lines will be readily visible. In the case of a right handed golfer, a deviation of the putter inside the lines or toward the golfer represents a "pull" which would cause the ball to roll to the left of its intended track while a deviation outside or away from the golfer is a "push" causing the ball to roll to the right of the intended track. For a left handed golfer a "pull" will cause the ball to roll to the right while a "push" will result in a deviation to the left of the intended track.

Between each putter head guide line 9 and the longitudinal edges of the sheet 2 is a set of four lines forming shoulder guides 10*a* and *b*. One set is for left handed golfers and the other is for right handers. The pairs of lines are offset relative to center line 6 toward the end of the sheet 2 wherein gauge 8 is located so that the golfer may align his shoulders for proper ball address while keeping his leading eye over the ball position 7. Two rows of lines in each set accommodate golfers of different heights. As shown in FIG. 1, the position of one set of shoulder guides 10*a* is such that gauge 8 is toward the left; this is the position for use by a left handed golfer. Rotating the device 180 degrees so that the second set of shoulder guides 10*b* is lowermost puts gauge 8 toward the golfer's right which is the correct position for a right handed golfer. This provision and positioning allows the same device to be used for left and right handed golfer's.

While not necessary, it is preferred that indicia be provided to indicate proper positioning for use by right and left handed golfers. This may be as shown in FIG. 1 with the words "RIGHT HAND" and "LEFT HAND" printed in their respective corners or simply "R" and "L" or other indicia suitable to indicate right and left. As noted previously, this indicia should be placed such that for right handers gauge 8 is to the right of center line 6 while for left handers it is to the left. Preferably the "LEFT" and "RIGHT" indicia are placed so that they are on the side of the sheet 2 corresponding to the golfer's left or right hand as he is using the device. Accordingly, for a right handed golfer the "RIGHT HAND" indicia would be to his right while for a left handed golfer the "LEFT HAND" indicia would be to his left. Similarly, shoulder guides 10*a* and *b* are offset to the right for right handers and to the left for left handers.

In use, the device 1 is placed on the surface, whether the ground or a floor, in the correct attitude for the particular user with the longitudinal axis and target line 5 in line with the desired direction of ball travel. Positioning will be such that gauge 8 is opposite to the direction of ball travel. When used on an actual golf course green, the alignment of the device may not necessarily be directly toward the hole especially on a breaking green. The golfer must still know how the read the green for the proper angle at which to putt. A ball may be placed at ball position 7 or, if one is merely practicing, the ball may be dispensed with and the golfer may simply use the device to check his stance and stroke relative to ball position 7.

After positioning the device according to need, a golfer positions himself over sheet 2 so as to see his reflection therein relative to the indicia 4 thereon. In the case of a right handed golfer, he will place his toes at the longitudinal edge nearest him with gauge 8 on his right hand; a left handed golfer will position sheet 2 such that gauge 8 will be on his left. Depending on the golfer's height or build, the toes may not necessarily be right at the edge of sheet 2 but may be spaced therefrom. However, a proper putting stance is one where the feet are parallel and an equal distance from the ball or with the leading foot slightly further from the ball than the trailing foot. The latter position is known as an "open" stance. For both left and right handed golfers a "closed" stance, which is one where the leading foot is closer to the ball than the trailing foot, is to be avoided. The present invention helps golfers to detect a "closed" stance by providing them with a reference point in the form of the edge of sheet 2 against which their foot positions may be judged.

When his feet are properly positioned, the golfer aligns his shoulders with each of a pair of left and right shoulder guide lines 10*b* and positions his head so that the reflected image of his eyes is in line with target line 5 and his left eye is superimposed over ball position 7. This will place the golfer in the proper stance for putting. Once in position, the golfer may then watch his reflection as he proceeds through a putting stroke and see if his stance wavers or if he peeks by checking the position of his reflection relative to the indicia 4 on sheet 2. At the same time he can watch the putter head and its reflection relative to gauge 8 and putter head guide lines 9 for any indication of a tendency to move the putter off square with the ball or to pull or push. An off square putter will be shown by the putter head and its reflection being off center with the lines of gauge 8 as the putter proceeds through the stroke while pushing or pulling will be evidenced by the reflection being outside, to one side or the other, of putter head guide lines 9.

Accordingly, the herein described device provides a simple and efficient guide for golfers to check their putting stance and stroke for errors and to be able to easily see and correct such errors. The foregoing disclosure and description of the invention are illustrative and explanatory thereof, and various changes in size, shape and material as well as in the details of the illustrated construction may be made without departing from the spirit of the invention.

What is claimed is:

1. A golf putting and practice aid comprising a substantially rectangular sheet having a longitudinal axis and a transverse axis and bearing indicia in a manner to be viewable relative to the user's reflection and indicative of said user's stance and stroke in the act of putting, said indicia comprising:

a target line centrally located on said sheet along said longitudinally axis and extending the length of said sheet;

a center line centrally located on said sheet along said transverse axis perpendicular to and bisecting said target line;

the intersection of said lines defining a location on which a golf ball may be positioned for putting;

a pair of putter head guide lines parallel to and on either side of said target line and extending the length of said sheet and spaced apart a distance corresponding to the length of a putter head;

a plurality of pre-impact correction and backstroke gauge lines perpendicular to and intersecting said target line and spaced sequentially along said target line on one side of said intersection, a plurality of shoulder guide lines parallel to said putter head guide lines and located between said putter head guide lines and respective longitudinal edges of said sheet, and said sheet comprises a relatively thin sheet of transparent material 18 inches long and 12 inches wide and on one surface thereof a layer of vacuum deposited aluminum forms a reflective surface against which said indicia may be viewed.

2. The device of claim 1 wherein said indicia are printed on the surface of said sheet of transparent material opposite said aluminum layer.

3. The device of claim 1 wherein said indicia are printed on the same surface of said sheet as said aluminum layer prior to application of said aluminum layer and are viewed through the thickness of said transparent sheet.

4. The device of claim 1, wherein said indicia are printed on a surface of said sheet in a manner to be useable by right handed and left handed persons by rotating said device 180 degrees about a vertical axis passing through the intersections of said target and center lines.

5. The device of claim 1 wherein said center line extends from one putter head guide line to the other putter head guide line and is perpendicular thereto and wherein the intersection of said target line and said center line at the center of said sheet provides a reference point for a golf ball and for a user's eyes.

6. The device of claim 5 wherein said pre-impact correction and backstroke gauge lines are located between said putter head guide lines and to one side of said center line and are of progressively decreasing length.

7. The device of claim 6 wherein said shoulder guide lines, being parallel to and outside of said putter head guide lines between said putter head guide lines and the respective longitudinal edges of said sheet comprise two sets of said guide lines for use by right and left handed golfers; each set further comprising two pair of parallel lines spaced apart and longitudinally offset relative to said center line toward the half of said sheet bearing said pre-impact correction and backstroke gauge lines.

8. The device of claim 7 bearing indicia indicating correct positioning of said sheet for use by right handed or left handed persons, said device being rotationally reversible 180 degrees between left handed and right handed positions.

9. The device of claim 1 wherein said sheet is a flexible, reflectorized polymer material and said indicia are printed on the reflective surface thereof.

* * * * *